US008356881B2

(12) United States Patent
Ohnishi

(10) Patent No.: US 8,356,881 B2
(45) Date of Patent: Jan. 22, 2013

(54) INKJET PRINTER

(75) Inventor: Masaru Ohnishi, Tomi (JP)

(73) Assignee: Mimaki Engineering Co., Ltd., Tomi-Shi (JP)

( * ) Notice: Subject to any disclaimer, the term of this patent is extended or adjusted under 35 U.S.C. 154(b) by 120 days.

(21) Appl. No.: 12/954,628

(22) Filed: Nov. 25, 2010

(65) Prior Publication Data

US 2011/0109693 A1 May 12, 2011

Related U.S. Application Data

(63) Continuation of application No. PCT/JP2009/006842, filed on Dec. 14, 2009.

(30) Foreign Application Priority Data

Dec. 15, 2008 (JP) ..... 2008-317918

(51) Int. Cl.
*B41J 2/165* (2006.01)
*B41J 29/17* (2006.01)

(52) U.S. Cl. ..... 347/34

(58) Field of Classification Search ..... 347/34
See application file for complete search history.

(56) References Cited

U.S. PATENT DOCUMENTS 4,369,450 A * 1/1983 Iwagami et al. ..... 347/34
5,774,141 A * 6/1998 Cooper et al. ..... 347/34
6,719,398 B1 * 4/2004 McElfresh et al. ..... 347/21
6,945,628 B2 * 9/2005 Koitabashi et al. ..... 347/34
7,604,332 B2 * 10/2009 Nagashima ..... 347/84

FOREIGN PATENT DOCUMENTS

| | | |
|---|---|---|
| JP | 62-111749 | 5/1987 |
| JP | 11-334106 | 12/1999 |
| JP | 2000-062197 | 2/2000 |
| JP | 2005-161758 | 6/2005 |
| JP | 2006-168151 | 6/2006 |

OTHER PUBLICATIONS

International Search Report for International Application No. PCT/JP2009/006842, Jan. 19, 2010.

* cited by examiner

*Primary Examiner* — Shelby Fidler
*Assistant Examiner* — Alexander D Shenderov
(74) *Attorney, Agent, or Firm* — Ditthavong Mori & Steiner, P.C.

(57) ABSTRACT

An inkjet printer includes a media supporter, a head device, and an ink mist removal mechanism. The media supporter is configured to support a printing medium. The head device includes an inkjet head from which ink is configured to be discharged to print on the printing medium supported by the media supporter while the head device relatively moves with respect to the printing medium. The ink mist removal mechanism is arranged in the head device and faces the printing medium. The ink mist removal mechanism is configured to generate an air current that flows through a space between the head device and the printing medium. The ink mist removal mechanism is configured to discharge the air current to outside thereby removing ink mist generated due to ink discharge from the inkjet heads.

6 Claims, 6 Drawing Sheets

INKJET PRINTER

CROSS-REFERENCE TO RELATED APPLICATIONS

The present application is a continuation application of International Application No. PCT/JP2009/006842, filed Dec. 14, 2009, which claims priority to Japanese Patent Application No. 2008-317918, filed Dec. 15, 2008. The contents of these applications are incorporated herein by reference in their entirety.

BACKGROUND OF THE INVENTION

1. Field of the Invention

The present invention relates to an inkjet printer.

2. Discussion of the Background

In such inkjet printers, a plurality of inkjet heads corresponding to each color is arranged in a head device. Printing of desired characters or graphics, designs, photographs, etc. is performed by discharging ink drops from many nozzles provided in the inkjet heads and depositing ink layers on a printing medium. At this time, if a compatibility between the inkjet heads and the printer, or optimization of a driving method of the head device is inadequate, etc., ink drops called satellites (hereinafter, referred to as satellite ink drops) that are of a droplet-size smaller than the ink drops may be formed following the desired ink drops discharged by an ink discharge control.

Because a mass of these satellite ink drops is less than that of the desired ink drops, a dropping velocity of the satellite ink drops is easily affected by an air resistance. Furthermore, a dropping trajectory of the satellite ink drops is also easily affected by air currents caused by movement of the head device. As a result, the dropping velocity may rapidly decrease due to an influence of the air resistance of some of the satellite ink drops, moreover, the dropping trajectory may deviate from a desired trajectory due to an influence of the air current caused by the movement of the head, and ink drops called mist (hereinafter, referred to as ink mist) that float inside the printer (between the head device and the printing medium) without depositing on a surface of the printing medium may be produced. The ink mist thus generated deposits on nozzle surfaces of the inkjet heads and causes discharge failure. Furthermore, it deposits on other structural members of the printer and stains them. Damage from such mist becomes further prominent in cases where printing is performed is a situation where there is a comparatively bigger gap between the nozzle surface (a surface on which many nozzles are formed) of the inkjet heads and the printing medium. Such a situation arises, for example, when printing is performed on a surface of a textured printing medium, or in textile inkjet printers where fluffiness of a fabric needs to be avoided.

Conventionally, an inkjet printer (for example, see Japanese Patent Application Laid-open No. S62-111749) that includes a mist suction path and an ink mist suction unit is known as a countermeasure against such ink mist. In this inkjet printer, there is provided a suction fan that is arranged separately from the head devices, and the mist suction path is connected integrally with the head devices via the suction fan and an air suction tube. The ink mist suction unit sucks the ink mist, which is generated during printing, along with air from a suction port of the mist suction path using the suction fan and captures the ink mist using built-in filters arranged in the mist suction path. Moreover, in a drying unit disclosed in Japanese Patent Application Laid-open No. S62-111749, the air passing through the filters is not exhausted to the outside from an exhaust port of the suction fan; however, it is guided to a discharge path arranged in the head device via an air supply tube installed in the exhaust port. After the air is heated using a built-in heater arranged in the discharge path, it is discharged from a discharge port of the discharge path onto an already printed portion on the printing medium and the ink is dried.

However, in the conventional ink mist countermeasure described above, the suction port that sucks the ink mist opens opposite the printing medium, and the air between the head device and the printing medium is sucked almost in a perpendicular direction with respect to the printing medium. Moreover, the head device sucks the air while moving with respect to the printing medium. Therefore, the air between the head device and the printing medium cannot be sucked smoothly and the ink mist cannot be removed effectively. To solve this problem, it may be considered to increase a suction force of the suction port by increasing a number of rotations of the suction fan. However, this method required special suction fans having a high suction force, or to provide plural suction fans. Therefore, particularly, while applying to large-size inkjet printers, this method presented problems of increased cost and loud noise.

SUMMARY OF THE INVENTION

According to one aspect of the present invention, an inkjet printer includes a media supporter, a head device, and an ink mist removal mechanism. The media supporter is configured to support a printing medium. The head device includes an inkjet head from which ink is configured to be discharged to print on the printing medium supported by the media supporter while the head device relatively moves with respect to the printing medium. The ink mist removal mechanism is arranged in the head device and faces the printing medium. The ink mist removal mechanism is configured to generate an air current that flows through a space between the head device and the printing medium. The ink mist removal mechanism is configured to discharge the air current to outside thereby removing ink mist generated due to ink discharge from the inkjet heads.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 2:
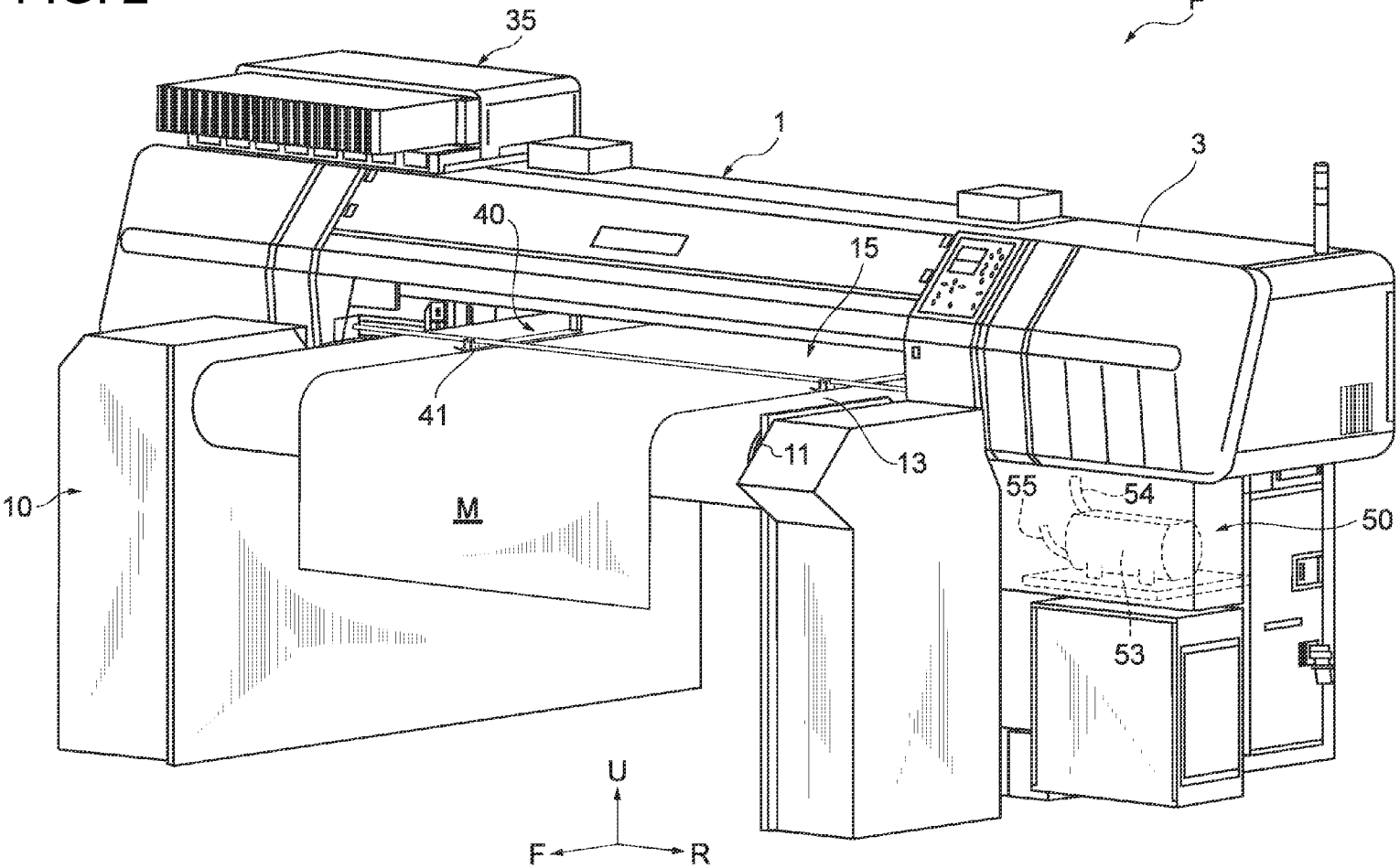
FIG. 2 is a perspective view of the inkjet printer when viewed obliquely from front.
Figure 3:
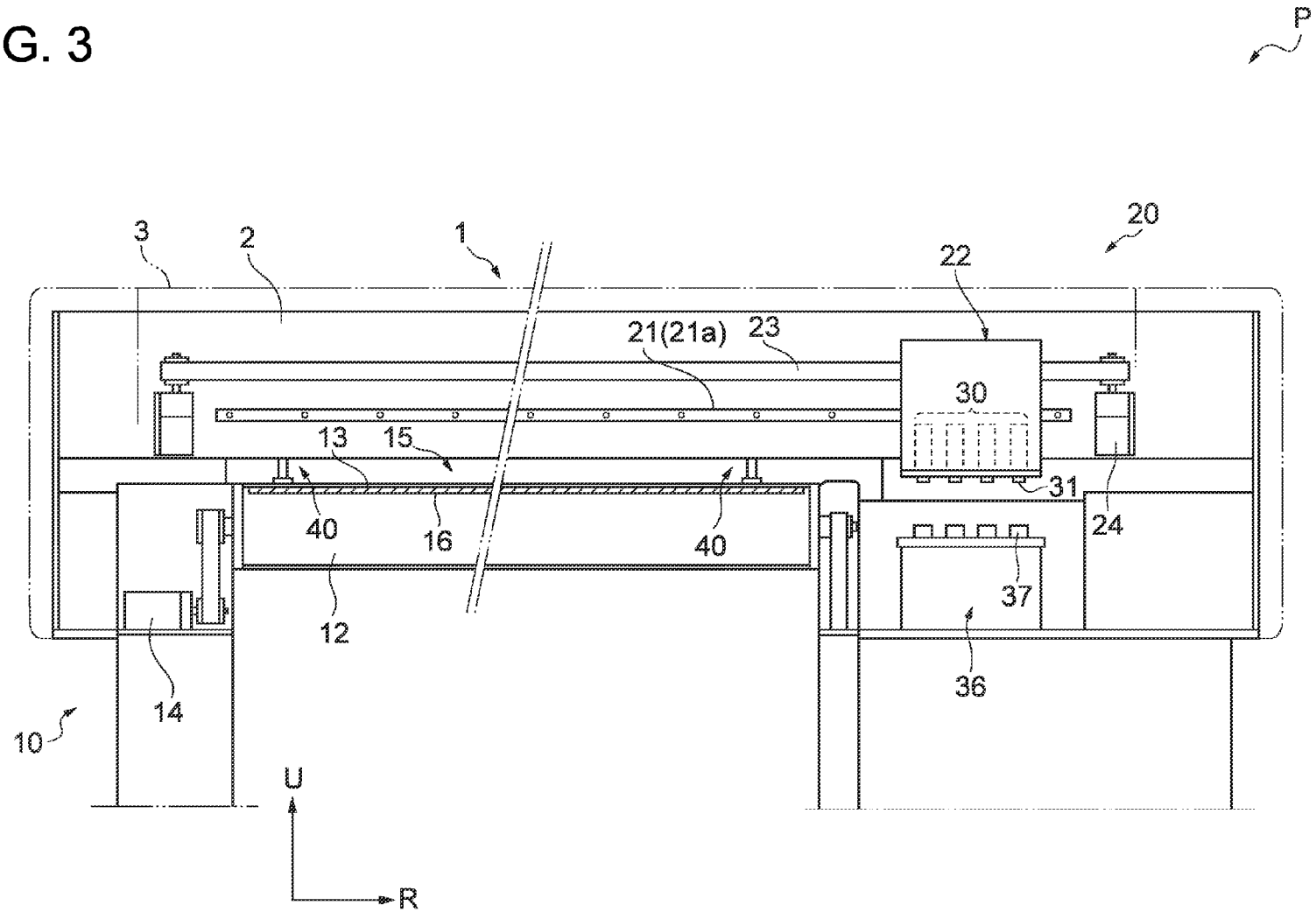
FIG. 3 is a front view (partial cross-section) showing the case and a structure of a media moving mechanism that configure the inkjet printer.

Exemplary embodiments of the present invention are explained below with reference to the accompanying drawings, wherein like reference numerals designate corresponding or identical elements throughout the various drawings. In the present embodiment, a configuration example is explained in which the embodiment of the present invention is applied to a textile inkjet printer that uses a band-shaped cloth, which is horizontally wider and longitudinally longer, as a printing medium M. FIG. 2 is a perspective view of an inkjet printer P when viewed obliquely from front and FIG. 3 is a schematic structure of the inkjet printer P. First, a schematic structure of the inkjet printer P is explained with reference to these drawings. Meanwhile, in the following explanation, directions indicated by arrows F, R, and U are forward direction, rightward direction, and upward direction, respectively.

The inkjet printer P broadly includes a media moving mechanism 10 and a head moving mechanism 20. The media moving mechanism 10 moves the printing medium M, which is supported on an upper surface, in a longitudinal direction. The head moving mechanism 20 is arranged inside a case 1, which straddles over the media moving mechanism 10 and extends horizontally, and that horizontally moves an inkjet head 30 mounted in a carriage 22. The inkjet printer P is configured such that ink is discharged from a nozzle of the inkjet head 30, which horizontally reciprocates an upper side of the printing medium M, and an image is formed on the printing medium M that is intermittently moved by the media moving mechanism 10 in the longitudinal direction.

The media moving mechanism 10 includes a first roller 11 and a second roller 12 arranged longitudinally across the case 1, an endless-band-shaped conveyance belt 13 that is wider than the printing medium M in the horizontal direction and that is wound around the first roller 11 and the second roller 12, and a media drive motor 14 that rotates the conveyance belt 13 by driving at least one of the first roller 11 and the second roller 12 (the second roller 12 is driven in the structural example shown in FIG. 3) to rotate. The printing medium M is moved in the longitudinal direction by controlling rotation of the media drive motor 14. A support plate 16 that supports a lower surface of the conveyance belt 13 is arranged between the first roller 11 and the second roller 12, and a horizontal media supporter 15 is formed on an upper surface of the conveyance belt 13. Thus, the media moving mechanism 10 is configured in a shape of a wide belt conveyor and it is arranged projecting in a forward direction and a backward direction of the case 1.

Although following details are not shown in the drawings, an adhesion processing is performed on an outer peripheral surface of the conveyance belt 13, and an anti-wrinkle roller that removes wrinkles on the printing medium M forwarded from a forwarding mechanism and a rotation-pressing roller that presses and causes the printing medium M, with the wrinkles removed thereon, to adhere to the conveyance belt 13 are arrange backward of the media moving mechanism 10. Furthermore, a separating roller that separates the printing medium M adhered to the conveyance belt 13 and a rolling mechanism that rolls the printing medium M are arranged forward of the media moving mechanism 10. Therefore, the printing medium M inserted from backward of the media moving mechanism 10 is conveyed forward without being displaced or distended when it adheres to the conveyance belt 13 while conveying, and the printing medium M on which printing has been completed is rolled forward of the media moving mechanism 10.

The head moving mechanism 20 is arranged inside a cover 3 that is arranged inside the case 1 straddling over the media moving mechanism 10. The head moving mechanism 20 mainly includes a direct acting bearing 21 that is fixed to a front surface of a frame 2 forming a base on the structure inside the case 1 and that extends horizontally, the carriage 22 horizontally movably supported on a guide rail 21*a* of the direct acting bearing 21 via a bearing block 21*b* (see FIG. 1), a drive belt 23, which is rolled by a drive pulley and a driven pulley arranged on right and left side portions of the frame 2, and a middle portion thereof is fixed to the carriage 22, and a carriage drive motor 24 that drives the drive pulley to rotate. The carriage 22 that is fixed to the drive belt 23 is horizontally reciprocated by controlling rotation of the carriage drive motor 24.

Inside the carriage 22 is aligned a plurality of the inkjet heads 30 on which many nozzles are formed that discharge several minute ink drops. A nozzle surface 31 (a surface on which the nozzles are formed) on a lower end of the head is arranged opposite the media supporter 15 with a predetermined gap. Various forms for arranging the inkjet heads 30 are available. However, in the inkjet printer P according to the present embodiment, many nozzles are linearly disposed in a longitudinal direction. According to a head configuration illustrated in the present embodiment (see FIG. 5), four inkjet heads 30 (for example, inkjet heads for basic colors YMCK), which are formed by disposing the nozzles in two parallel rows, are arranged horizontally, thus arranging total eight nozzle rows.

An ink station 35 that includes a cartridge-type ink tank for each color is arranged on a top left side of the case 1. The ink tank for each color and a corresponding inkjet head 30 are connected via an ink tube (not shown), and ink is suitably supplied from each ink tank to the corresponding inkjet head 30. Moreover, a head lifting mechanism that moves the carriage 22 upward and downward is arranged inside the case 1. The gap between the nozzle surface 31 of the inkjet heads 30 and the media supporter 15 can be adjusted depending on the thickness of the printing medium M, which serves as a print target, using the head lifting mechanism. A maintenance mechanism 36 is arranged inside the case 1 (a position towards right of the media supporter 15). The maintenance mechanism 36 moves the carriage 22 to extreme left of the guide rail 21*a* at a position (hereinafter, referred to as "home position") where the nozzle surface 31 of the inkjet heads 30 and the maintenance mechanism 36 come face to face one above the other, and performs cleaning of the inkjet heads 30 such as suction removal of residual ink inside the nozzles or excess ink adhered to a nozzle circumference.

A media pressing mechanism 40 is arranged on a lower side of the frame 2 in the case 1. The media pressing mechanism 40 includes a band plate-shaped media presser 41 extending longitudinally and disposed symmetrically with respect to a center line of the horizontal direction of the media moving mechanism 10, and a media presser supporting mechanism (not shown) that is arranged on the lower side and a back side of the frame 2 and that provides a hanging support to the media presser 41 such that the media presser 41 can move vertically and horizontally. The media pressing mechanism 40 presses from above left and right edges of the printing medium M moved longitudinally and supported by the media supporter 15. Thus, fluffy portions on the left and right edges of the printing medium M that is supported by the media supporter 15 are pressed by the media presser 41, and even though the inkjet heads 30 are moved horizontally above the fluffy portions, the nozzle surface 31 of the inkjet heads 30 and the printing medium M do not rub against each other, and the inkjet heads 30 are not trapped in the fluff.

In the inkjet printer P, the printing medium M supported by the media supporter 15 is intermittently fed in the forward direction and positioned by controlling rotation of the media drive motor 14 of the media moving mechanism 10, and an oblong band-shaped printing area is formed on the printing medium M by synchronously controlling rotation of the carriage drive motor 24, which is in the head moving mechanism 20, and ink discharge from the nozzles of each inkjet head 30. Furthermore, by controlling an intermittent feed of the printing medium M in the forward direction by the media moving mechanism 10, and the ink discharge from the nozzles of each inkjet head 30 in synchronization with a reciprocative movement of the inkjet heads 30 in the horizontal direction by the head moving mechanism 20, images of characters or graphics, etc. according to a print program are formed on the printing medium M.

While the printing is being carried out, satellite ink drops of a droplet-size smaller than the ink drops could be discharged from the nozzles of the inkjet heads 30 following the desired ink drops discharged depending on an ink discharge control. Because a mass of the satellite ink drop is less than that of the desired ink drop, its dropping velocity is likely to be affected by an air resistance. Furthermore, its dropping trajectory is likely to be affected by air currents caused by the movement of the carriage 22 by the head moving mechanism 20. As a result, the dropping velocity of the satellite ink drop rapidly decreases due to an influence of the air resistance, moreover, the dropping trajectory deviates from a desired trajectory due to an influence of the air currents caused by the carriage movement, and ink mist that does not adhere to a front surface of the printing medium M and floats inside the case 1, specifically, in a space (space on the upper side of the printing medium M) between the nozzle surface 31 of the inkjet heads 30 and the printing medium M is produced.

Figure 1:
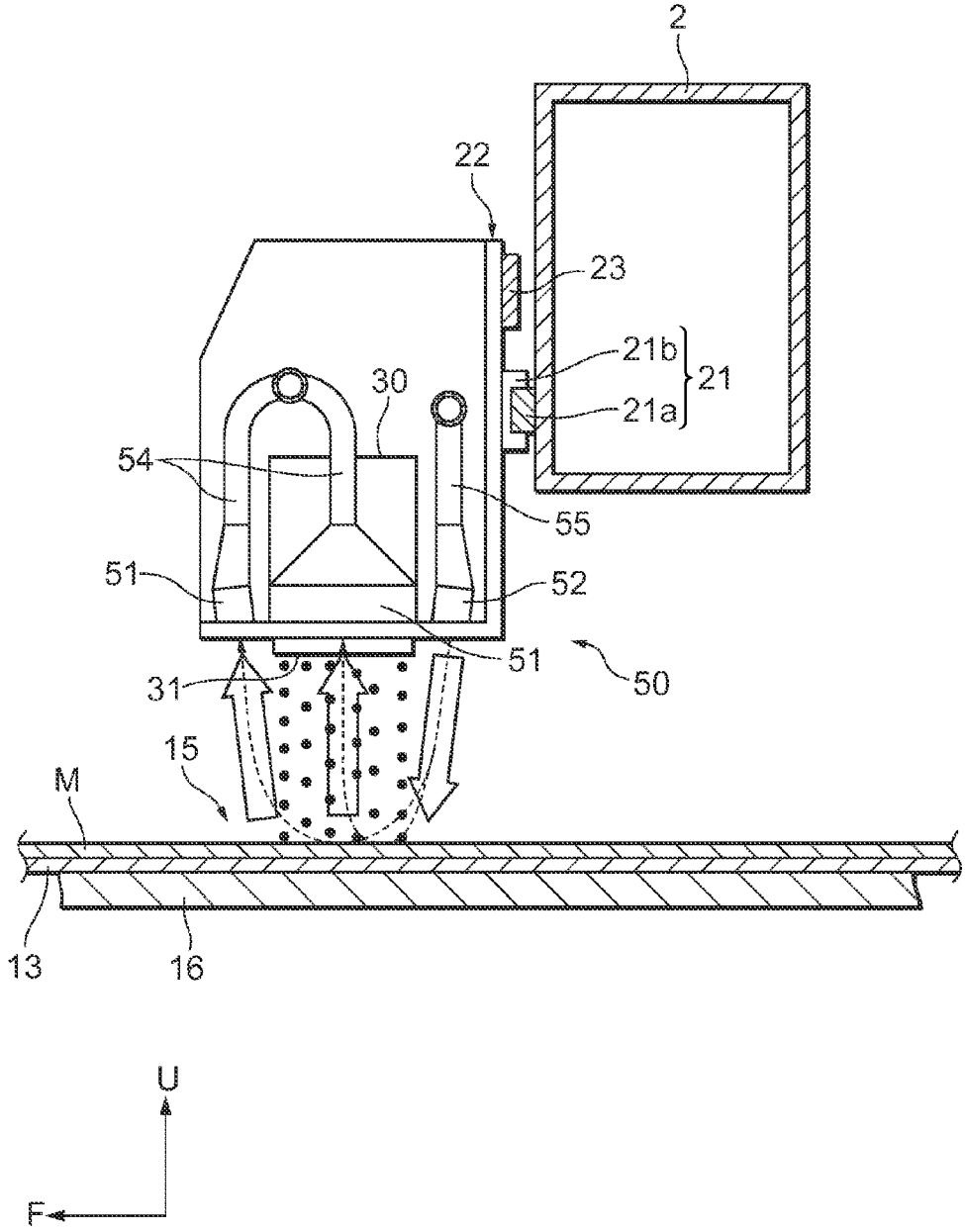
FIG. 1 is a sectional view in a longitudinal direction showing principal parts around a carriage inside a case that configures an inkjet printer according to an embodiment of the present invention.
Figure 4:
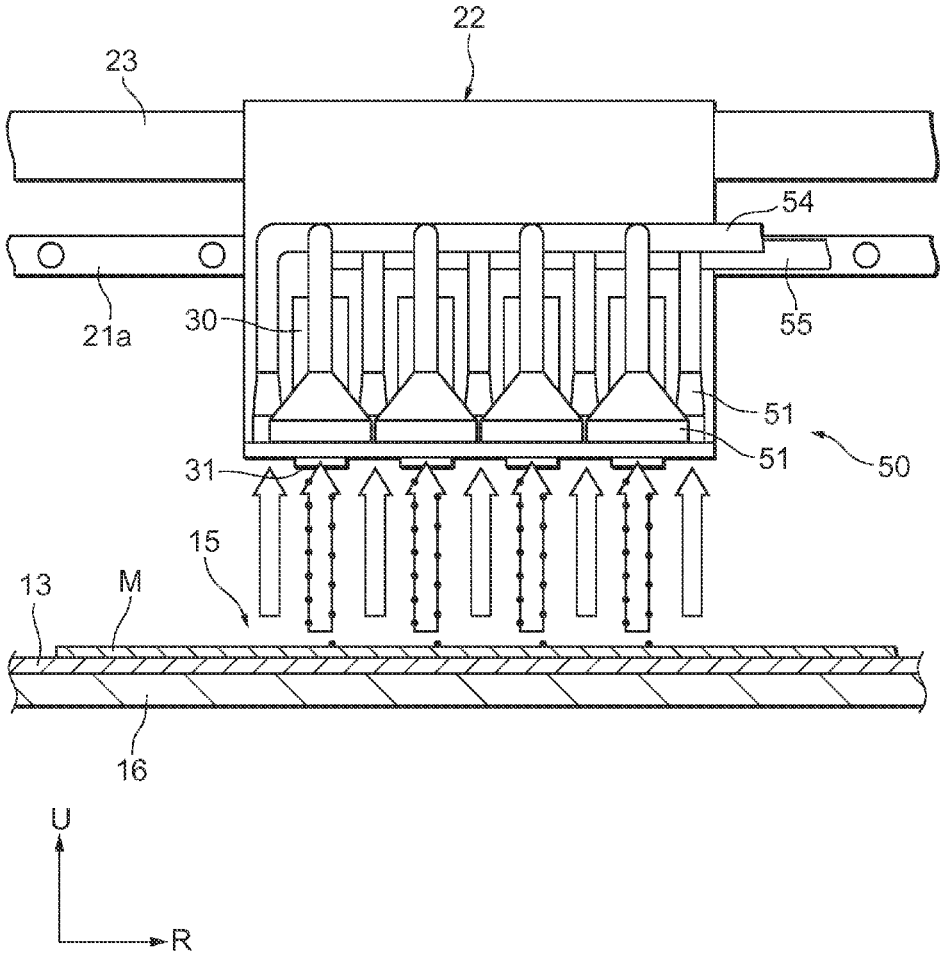
FIG. 4 is a front view showing the principal parts around the carriage arranged inside the case.
Figure 5:
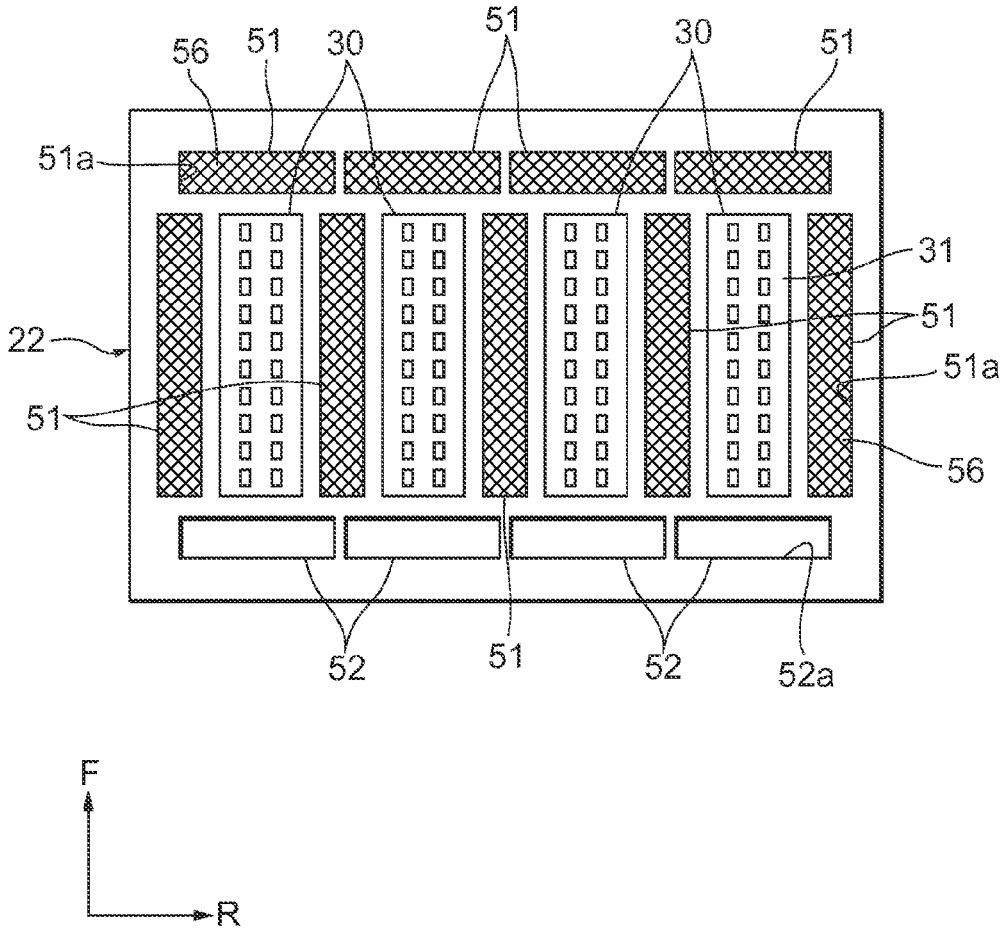
FIG. 5 is a bottom view of the carriage showing an arrangement of inkjet heads, suction side ducts, and discharge side ducts arranged in the carriage.

To take of this issue, the inkjet printer P thus configured includes an ink mist suction removal mechanism 50 that effectively removes the ink mist that is generated. FIGS. 1 and 4 are drawings showing principal parts surrounding the carriage 22 inside the case 1, and FIG. 5 is a drawing showing a bottom view of the carriage 22. The ink mist suction removal mechanism 50 is explained by collectively referring to these drawings. In FIGS. 1 and 4, to clearly show an air flow generated by the ink mist suction removal mechanism 50, the gap between the nozzle surface 31 of the inkjet heads 30 and the printing medium M is shown bigger than a gap in a real situation. Moreover, granular ink drops discharged from the nozzles of the inkjet heads 30 are schematically shown as black spots.

The ink mist suction removal mechanism 50 mainly includes a plurality of (in the present embodiment, five on left and right sides, and four on a front side) suction side ducts 51 arranged on the left and right sides and on the front side of each inkjet head 30 inside the carriage 22, a plurality of (in the present embodiment, four) discharge side ducts 52 arranged on a back side of each inkjet head 30 inside the carriage 22, a pneumatic pump 53 arranged inside a base that supports the case 1 (see FIG. 2), an air suction tube 54 that connects a suction port of the pneumatic pump 53 and each suction side duct 51, and an air supply tube 55 that connects a discharge port of the pneumatic pump 53 and each discharge side duct 52.

Each suction side duct 51 includes an internal airflow path. Moreover, a tube mounting port to which the air suction tube 54 is connected is formed on an upper end, and a suction port 51*a* is formed on a lower end of each suction side duct 51. The suction side ducts 51 are arranged on the left and right sides (both sides of a carriage moving direction) and on the front side of each inkjet head 30 inside the carriage 22. Filters 56 that capture the ink mist, which is sucked along with the air from the suction port 51*a*, are arranged in the airflow path inside the suction side ducts 51. Furthermore, the filters 56 possess coarseness sufficient for not disturbing an air circulation in the airflow path and fineness sufficient for enabling capturing of the ink mist, thus having a suitable combination of coarseness and fineness.

The suction side ducts 51 arranged on the left and right sides of the heads are arranged in the carriage moving direction alternating with the inkjet heads 30. The suction ports 51*a* are rectangular and a longitudinal width of each suction port 51*a* is substantially equal to a longitudinal width of the nozzle surface 31. Similar to the nozzle surface 31, the suction ports 51*a* are arranged opposite the media supporter 15 near the nozzle surface 31. The suction ports 51*a* of the suction side ducts 51 arranged on the front side of the heads are rectangular and they extend horizontally beyond a horizontal width of the nozzle surface 31. Similar to the nozzle surface 31, the suction ports 51*a* are arranged opposite the media supporter 15 near the nozzle surface 31. Furthermore, the internal airflow path (longitudinal wall) in the suction side ducts 51 on the front side of the heads is made to incline towards the front, and a main component in a suction direction of the air sucked towards the suction port 51*a* is slightly inclined towards the front side than in a vertically upward direction (see an arrow shown in FIG. 1).

Similar to the suction side ducts 51, each discharge side duct 52 includes an internal airflow path. Moreover, a tube mounting port to which the air supply tube 55 is connected is formed on an upper end and a discharge port 52*a* is formed on a lower end of each discharge side duct 52. The discharge side ducts 52 are arranged on a back side of each inkjet head 30 in the carriage 22. Similar to the suction ports 51*a* on the front side of the heads, the discharge ports 52*a* are rectangular, and they extend horizontally beyond the horizontal width of the nozzle surface 31 and are arranged opposite the media supporter 15 near the nozzle surface 31. Furthermore, the internal airflow path (longitudinal wall) in the discharge side ducts 52 is made to incline from the front, and a main component in a discharge direction of the air discharged towards the discharge port 52*a* is slightly inclined towards the front side than in a vertically downward direction (see an arrow shown in FIG. 1).

The pneumatic pump 53 is a device that sucks the air from the suction port 51*a* of the suction side duct 51 via the air suction tube 54, feeds the sucked air inside the air supply tube 55, and discharges the air from the discharge port 52*a* of the discharge side duct 52. The pneumatic pump 53 generates an air current from the media supporter 15 towards the suction port 51*a* (hereinafter, referred to as "suction-side air current") along with generating an air current from the discharge port 52*a* towards the media supporter 15 (hereinafter, referred to as "discharge-side air current"). Meanwhile, by controlling the pneumatic pump 53, flow rates of the suction-side air current and the discharge-side air current can be independently controlled.

One end of the air suction tube 54 is connected to the suction port of the pneumatic pump 53, the other end is split into a plurality of branches (in the present embodiment, nine branches, i.e., the same as the number of the suction side ducts 51) and connected to the tube mounting port of each suction side duct 51. The air is sucked almost evenly from the suction port 51*a* of each suction side duct 51 using the pneumatic pump 53. One end of the air supply tube 55 is connected to the discharge port of the pneumatic pump 53, the other end is split into a plurality of branches (in the present embodiment, four branches, i.e., the same as the number of the discharge side ducts 52) and connected to the tube mounting port of each discharge side duct 52. The air fed from the pneumatic pump 53 is almost evenly distributed and supplied to each discharge side duct 52.

A portion of the air suction tube 54 and a portion of the air supply tube 55 are supported by a flexible guide (not shown), which connects the carriage 22 and the frame 2, along with the ink tube, etc. The air suction tube 54 and the air supply tube 55 are smoothly coupled by the flexible guide with respect to the reciprocative movement of the carriage 22, and the air is sucked from each suction side duct 51 and supplied to each discharge side duct 52 by the pneumatic pump 53.

Next, operations of the ink mist suction removal mechanism 50 in the inkjet printer P that is configured as above are explained briefly. The ink mist suction removal mechanism 50 operates before the ink discharge from the nozzle of each inkjet head 30 is started (or simultaneously when the ink discharge is started), sucks the air using the pneumatic pump 53 from the suction port 51*a* of the suction side duct 51 via the air suction tube 54, and generates, from a side of the printing medium M supported by the media supporter 15 (or from a side of the media supporter 15), an air current (hereinafter, referred to as "suction-side air current") towards the suction port 51*a*. Furthermore, the ink mist suction removal mechanism 50 discharges the sucked air from the discharge port 52*a* of the discharge side duct 52 via the air supply tube 55, and generates an air current (hereinafter, referred to as "discharge-side air current") from the discharge port 52*a* towards the printing medium M (media supporter 15). Moreover, the flow rates of the suction-side air current and the discharge-side air current are adjusted by the pneumatic pump 53 without having any effect on a discharge direction of the desired ink drops discharged from the inkjet heads 30.

At this time, in a space (a space on the upper side of the printing medium M opposite a lower surface of the carriage 22, and hereinafter, simply referred to as "upper space of the printing medium") between the front surface of the printing medium M and the lower surface of the carriage 22, an air current (hereinafter, referred to as "circulating air current") is generated that flows from the discharge port 52*a* to the suction port 51*a* via a neighborhood of the front surface of the printing medium M (see a dashed arrow in FIG. 1) due to the discharge-side air current and the suction-side air current. Thus, the ink mist generated along with the desired ink drops discharged from the inkjet heads 30 does not float on the upper space of the printing medium M due to the circulating air current, and it is immediately sucked from the suction port 51*a* to suction side ducts 51 and captured by the filters 56.

As explained above, in the inkjet printer P, by the action of the ink mist suction removal mechanism 50, the circulating air current can be generated that flows from the discharge ports 52*a* arranged on the back side of the inkjet heads 30 to the suction ports 51*a* arranged on the left and right sides (both sides of the carriage moving direction) and the front side of the inkjet heads 30, via the neighborhood of the front surface of the printing medium M, and because the air between the carriage 22 and the printing medium M can be smoothly sucked into the suctions ports 51*a* due to the circulating air current, the ink mist generated during printing can be effectively removed by suction. In the ink mist suction removal mechanism 50, because the suction-side air current and the discharge-side air current are produced using a single pneumatic pump 53, the configuration of the ink mist suction removal mechanism 50 can be simplified and kept compact, and also a need for exerting an activation control and a stoppage control for blowers on a discharge side and a suction side, respectively, is ruled out, thus enabling reduction in a control burden.

Figure 6A:
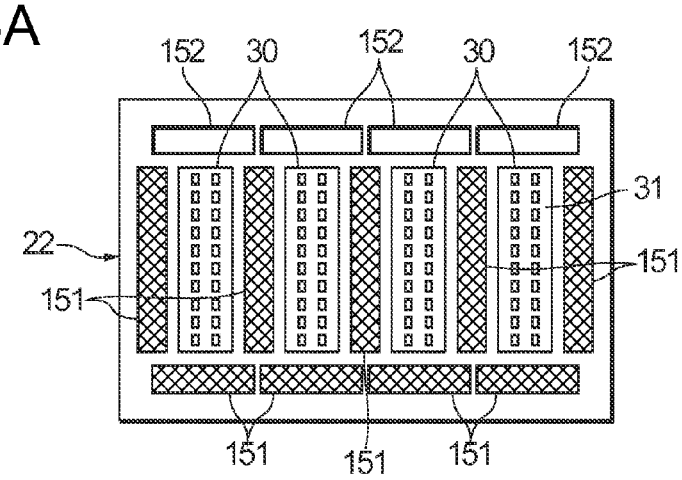
FIGS. 6A, 6B, and 6C are bottom views of the carriage showing arrangement of parts other than the suction side ducts and the discharge side ducts arranged in the carriage.
Figure 6B:
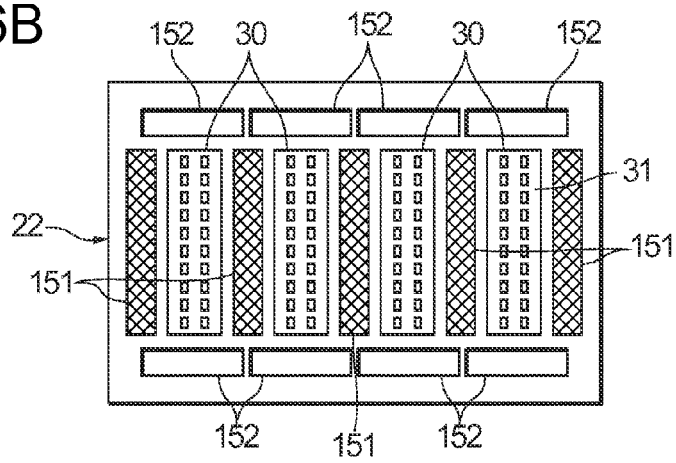
Figure 6C:
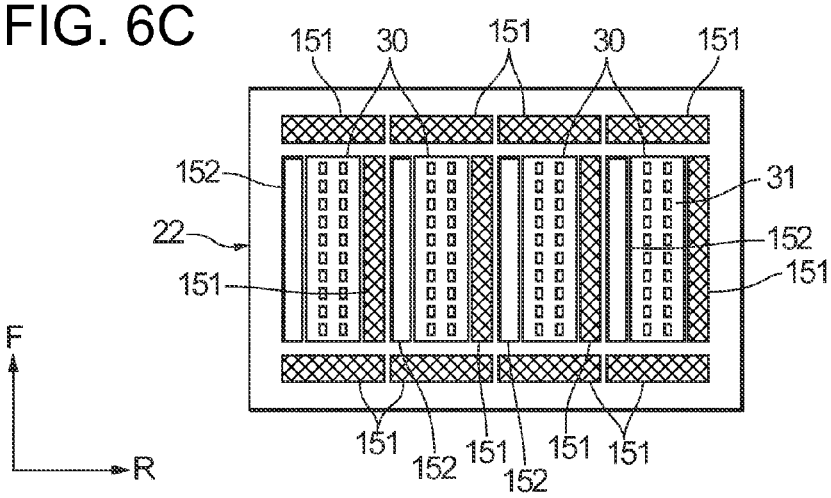

The scope of the present invention is not limited to the embodiment described above. For example, in the above embodiment, the suction side ducts 51 are arranged on the left and right sides and the front side of the inkjet heads 30, and the discharge side ducts 52 are arranged on the back side of the inkjet heads 30. However, the arrangement is not limited to this. For example, as shown in FIG. 6(*a*), suction side ducts 151 can be arranged on the left and right sides and the back side of the inkjet heads 30, and discharge side ducts 152 can be arranged on the front side of the heads 30. Alternatively, as shown in FIG. 6(*b*), the suction side ducts 151 can be arranged on the left and right sides of the heads 30, and the discharge side ducts 152 can be arranged on the front and back sides of the heads 30, or as shown in FIG. 6(*c*), the suction side ducts 151 can be arranged on the right side (or left side) and the front and back sides of the heads 30, and the discharge side ducts 152 can be arranged on the left side (or right side) of the heads 30. Thus, the arrangement of the suction side ducts and the discharge side ducts can be suitably modified. Furthermore, the suction side ducts arranged on the left and right sides and the front side (or back side) of the inkjet heads can be arranged as a single integrated body having an inverted U shape enclosing the left, right, and front (or back) sides of the heads.

Moreover, the ink mist suction removal mechanism described in the above embodiment is configured with the pneumatic pump arranged inside the base (inside the inkjet printer) supporting the case; however, the pneumatic pump can be arranged separately from the inkjet printer, or a smaller pneumatic pump can be arranged inside the carriage along with the inkjet heads, etc. Furthermore, in the embodiment described above, a single pneumatic pump (blower) is used to produce the discharge-side air current as well as the suction-side air current. However, two blowers, one for producing the discharge-side air current and the other for producing the suction-side air current, can be provided.

Moreover, in the embodiment described above, although a textile inkjet printer that performs printing on a wide and long band-shaped cloth is taken as an example of the inkjet printer to which the present invention is applied, the present invention can be applied to inkjet printers that perform printing on printing media other than the cloth. However, in textile inkjet printers in which fluffiness of a fabric needs to be avoided or in inkjet printers that use UV ink, printing is often performed by securing a comparatively bigger gap between the nozzle surface of the inkjet heads and the front surface of the printing medium, due to which ink mist is easily generated. Therefore, by applying the present invention to such inkjet printers, the above effects can be achieved on a greater scale.

An inkjet printer according to the embodiment of the present invention is an inkjet printer in which ink is discharged from an inkjet head (for example, a carriage 22 and inkjet heads 30 in the embodiment) arranged in a head device while moving the head device with respect to a printing medium supported by a media supporter to perform desired printing on the printing medium. The inkjet printer includes an air suction mechanism (for example, suction side ducts 51, a pneumatic pump 53, and an air suction tube 54 in the embodiment) that is arranged in the head device and facing the printing medium, the air suction mechanism includes a suction port that relatively moves with the inkjet head and sucks air thereby generating an air current that flows from a space between the head device and the printing medium towards the suction port, and an air discharge mechanism (for example, discharge side ducts 52, the pneumatic pump 53, and an air supply tube 55 in the embodiment) that is arranged in the head device and facing the printing medium, the air discharge mechanism includes a discharge port that relatively moves with the inkjet head and discharges air thereby generating an air current that flows from the discharge port toward the space between the head device and the printing medium. An air current that flows from the discharge port toward the suction port through the space between the head device and the printing medium is generated by the air suction mechanism and the air discharge mechanism.

In the inkjet printer having the above configuration, it is preferable that the suction port includes suction ports arranged on both sides of the inkjet head in a moving direction of the head device and includes a suction port arranged on one side of the inkjet head in an orthogonal direction orthogonal to the moving direction of the head device, and that the discharge port be arranged on one side of the inkjet head in the orthogonal direction, opposite the suction port.

In the inkjet printer having the above configuration, it is preferable that a single blower (for example, the pneumatic pump 53 in the embodiment) generates the air currents for the air suction mechanism and the air discharge mechanism.

According to the embodiment of the present invention, an inkjet printer includes an air suction mechanism and an air discharge mechanism. The air suction mechanism that is arranged in a head device sucks air from suction ports that relatively move with inkjet heads and generates an air current that flows from a space between the head device and a printing medium towards the suction ports. The air discharge mechanism that is arranged in the head device discharges the air from discharge ports that relatively move with the inkjet heads and generates an air current that flows from the discharge ports towards the space between the head device and the printing medium. Thus, due to the air suction mechanism and the air discharge mechanism, an air current that flows from the discharge ports towards the suction ports passing through the space between the head device and the printing medium can be generated, and because the air between the head device and the printing medium is smoothly sucked into the suction ports, ink mist generated during printing can be effectively removed by suction. Further, because it is not required to provide special suction fans having a high suction force or a number of the suction fans need not be increased, particularly, in large-size inkjet printers, problems of increased cost and loud noise are not presented, and the ink mist can be effectively removed by suction using an inexpensive structure.

According to the embodiment of the present invention, it is preferable to arrange the suction ports on both sides of the inkjet heads in a moving direction of the head device and on one side of the inkjet heads in an orthogonal direction orthogonal to the moving direction of the head device, and arrange the discharge ports on one side of the orthogonal direction, opposite the suction ports. If arranged in this manner, because a vector difference of ink discharged and the ink mist generated at that time is best appreciated in the moving direction of the head device, the ink mist can certainly be removed by suction using the suction ports arranged on both sides of the inkjet heads in the head moving direction. Further, unidirectional air currents that flow from the discharge ports arranged on one side of the inkjet heads in the orthogonal direction to each suction port are generated and the ink mist can be effectively removed by suction due to these air currents.

Moreover, it is preferable that the air suction mechanism and the air discharge mechanism are configured to have a single blower that generates air currents for each of them. If configured in this manner, structures of the air suction mechanism and the air discharge mechanism can be simplified and reduced in size, and also a need for exerting an activation control and a stoppage control for blowers of each mechanism is ruled out, thus enabling reduction in a control burden.

Obviously, numerous modifications and variations of the present invention are possible in light of the above teachings. It is therefore to be understood that within the scope of the appended claims, the invention may be practiced otherwise than as specifically described herein.

What is claimed is:

1. An inkjet printer comprising:

a media supporter configured to support a printing medium to be relatively movable with respect to the media supporter along a first direction;

a head device relatively movable with respect to the printing medium and the media supporter along a second direction orthogonal to the first direction, the head device comprising inkjet heads from which ink is configured to be discharged to print on the printing medium supported by the media supporter while the head device relatively moves with respect to the printing medium and the media supporter alone the second direction; and an ink mist removal mechanism arranged in the head device to face the printing medium supported by the media supporter, the ink mist removal mechanism being configured to generate an air current that flows through a space between the head device and the printing medium and being configured to discharge the air current to remove ink mist generated due to ink discharge from the inkjet heads, the ink mist removal mechanism comprising:

an air suction mechanism arranged in the head device to face the printing medium supported by the media supporter, the air suction mechanism including a first suction port relatively movable with the head device with respect to the printing medium and the media supporter along the second direction, the first suction port being provided between the inkjet heads and being configured to suck air to generate an air current that flows from a space between the head device and the printing medium towards the first suction port; and an air discharge mechanism arranged in the head device to face the printing medium supported by the media supporter, the air discharge mechanism including a first discharge port relatively movable with the head device with respect to the printing medium and the media supporter along the second direction the first discharge port being configured to discharge air to generate an air current that flows from the first discharge port toward the space between the head device and the printing medium, the air suction mechanism and the air discharge mechanism being configured to generate an air current that flows from the first discharge port toward the first suction port through the space between the head device and the printing medium, wherein the inkjet heads include a first inkjet head and a second inkjet head, the first suction port being provided between the first and second inkjet heads in the second direction, wherein the air suction mechanism includes a second suction port and a third suction port, the second suction port being arranged on an opposite side of the first suction port with respect to the first inkjet head in the second direction, the third suction port being arranged on a first side of the first inkjet head in the first direction, and wherein the first discharge port is arranged on a second side of the first inkjet head in the first direction, the second side being opposite to the first side with respect to the first inkjet head in the first direction.

2. The inkjet printer according to claim 1, wherein the ink mist removal mechanism further comprises a single blower configured to generate the air currents for the air suction mechanism and the air discharge mechanism.

3. The inkjet printer according to claim 2, wherein the ink mist removal mechanism further comprises filters to capture the ink mist and arranged in an airflow path of the air suction mechanism.

4. The inkjet printer according to claim 1, wherein the ink mist removal mechanism further comprises filters to capture the ink mist and arranged in an airflow path of the air suction mechanism.

5. An inkjet printer comprising:

a media supporter configured to support a printing medium to be relatively movable with respect to the media supporter along a first direction;

a head device relatively movable with respect to the printing medium and the media supporter along a second direction orthogonal to the first direction, the head device comprising inkjet heads from which ink is configured to be discharged to print on the printing medium supported by the media supporter while the head device relatively moves with respect to the printing medium and the media supporter along the second direction; and an ink mist removal mechanism arranged in the head device to face the printing medium supported by the media supporter, the ink mist removal mechanism being configured to generate an air current that flows through a space between the head device and the printing medium and being configured to discharge the air current to remove ink mist generated due to ink discharge from the inkjet heads, the ink mist removal mechanism comprising:

an air suction mechanism arranged in the head device to face the printing medium supported by the media supporter, the air suction mechanism including a first suction port relatively movable with the head device with respect to the printing medium and the media supporter along the second direction, the first suction port being provided between the inkjet heads and being configured to suck air to generate an air current that flows from a space between the head device and the printing medium towards the first suction port; and an air discharge mechanism arranged in the head device to face the printing medium supported by the media supporter, the air discharge mechanism including a first discharge port relatively movable with the head device with respect to the printing medium and the media supporter along the second direction, the first discharge port being configured to discharge air to generate an air current that flows from the first discharge port toward the space between the head device and the printing medium, the air suction mechanism and the air discharge mechanism being configured to generate an air current that flows from the first discharge port toward the first suction port through the space between the head device and the printing medium, wherein the inkjet heads include a first inkjet head and a second inkjet head, the first suction port being provided between the first and second inkjet heads in the second direction, wherein the air suction mechanism includes a second suction port relatively movable with the head device with respect to the printing medium and the media supporter along the second direction, the second suction port being provided on an opposite side of the first suction port with respect to the first inkjet head in the second direction and being configured to suck air to generate an air current that flows from the space between the head device and the printing medium towards the second suction port, wherein the air suction mechanism includes a third suction port relatively movable with the head device with respect to the printing medium and the media supporter along the second direction, the third suction port being provided on a first side of the first inkjet head in the first direction and being configured to suck air to generate an air current that flows from the space between the head device and the printing medium towards the third suction port, and wherein the first discharge port is arranged on a second side of the first inkjet head in the first direction, the second side being opposite to the first side with respect to the first inkjet head in the first direction.

6. The inkjet printer according to claim 5, wherein the media supporter is configured to support the printing medium to be movable with respect to the media supporter along the first direction from the second side of the first inkjet head toward the first side of the first inkjet head.

* * * * *